United States Patent [19]

Gort

[11] 4,442,853

[45] Apr. 17, 1984

[54] SAFETY GAS VALVE WITH LATCH

[75] Inventor: Ydo Gort, Aalden, Netherlands

[73] Assignee: Honeywell B.V., Amsterdam, Netherlands

[21] Appl. No.: 423,873

[22] Filed: Sep. 27, 1982

[30] Foreign Application Priority Data

Aug. 21, 1981 [DE] Fed. Rep. of Germany ..... 3133075

[51] Int. Cl.[3] ..... F23D 17/46

[52] U.S. Cl. ..... 137/66; 74/519; 251/113; 251/116; 251/243; 431/52; 431/54

[58] Field of Search ..... 137/66; 74/519; 251/66, 251/69, 74, 113, 115, 116, 232, 242, 243; 431/52, 53, 54

[56] References Cited

U.S. PATENT DOCUMENTS

| | | | |
|---|---|---|---|
| 2,719,531 | 10/1955 | Sogge | 137/66 |
| 2,969,077 | 1/1961 | Vicenzi et al. | 431/54 |
| 3,572,355 | 3/1971 | Van Der Linden | 431/54 |
| 3,574,308 | 4/1971 | Battersby | 431/52 |
| 3,780,600 | 12/1973 | Katchka | 74/519 |
| 3,877,475 | 4/1975 | Dietiker | 431/53 |
| 3,973,576 | 8/1976 | Dietiker | 137/66 |

FOREIGN PATENT DOCUMENTS

| | | |
|---|---|---|
| 1429062 | 8/1982 | Fed. Rep. of Germany . |
| 1519739 | 2/1967 | France . |
| 1084172 | 2/1965 | United Kingdom . |

*Primary Examiner*—George L. Walton

*Attorney, Agent, or Firm*—Clyde C. Blinn

[57] ABSTRACT

A safety gas valve with latch against non-permitted reopening has the connector of the thermoelectric power unit located on the same side of the housing as the push button of the operating rod which is born shiftable and turnable in the housing. For this purpose, besides a first lever, carrying the closure member and a latch as part of the latching mechanism and cooperating with the power unit, there is provided a second lever which is tiltable around the stationary axis of the first lever. The one end of the second lever engages the armature pin of the power unit, where the other end is positioned opposite an inclined surface of the latch and disengages the latch from the first lever which carries the closure member. In the normal operating position, a projection of the latch keeps the safety valve open. After closing the valve manually, a portion of the latch is located opposite a stationary abutment until the power unit is deenergized after cooling down the thermocouple.

7 Claims, 4 Drawing Figures

SAFETY GAS VALVE WITH LATCH

BACKGROUND AND SUMMARY OF THE INVENTION

The invention relates to a safety gas valve of the type disclosed in the Dietiker U.S. Pat. No. 3,973,576, issued Aug. 10, 1976. The object of the invention is to reduce the space required by such a safety gas valve insofar as the side of the housing located opposite the operating elements is kept free from all kinds of connections so that the mounting depth of the gas valve can be reduced.

The use of spring biased double levers as a mechanical coupling member between the closure member of the valve on the one side and the power unit or the operating push button on the other side is known as disclosed in British Pat. No. 1,084,172, and the Van der Linden U.S. Pat. No. 3,572,355, issued Dec. 13, 1968. In the British patent, the operating button and the connectors for electromagnet are located on opposite sides of the housing where neither a manual closing of the valve nor a latch is provided. In the safety gas valve according to U.S. Pat. No. 3,572,355, the operating push button and the connector for the power unit are located on the same side of the housing. However, a separate release push button is required for disengaging a mechanical clutch between the two levers when the valve is to be closed manually.

The present invention provides an improved safety gas valve with a latch to prevent unsafe reopening.

IN THE DRAWINGS

DESCRIPTION AND OPERATION OF THE PREFERRED EMBODIMENT OF THE INVENTION

Figure 1:
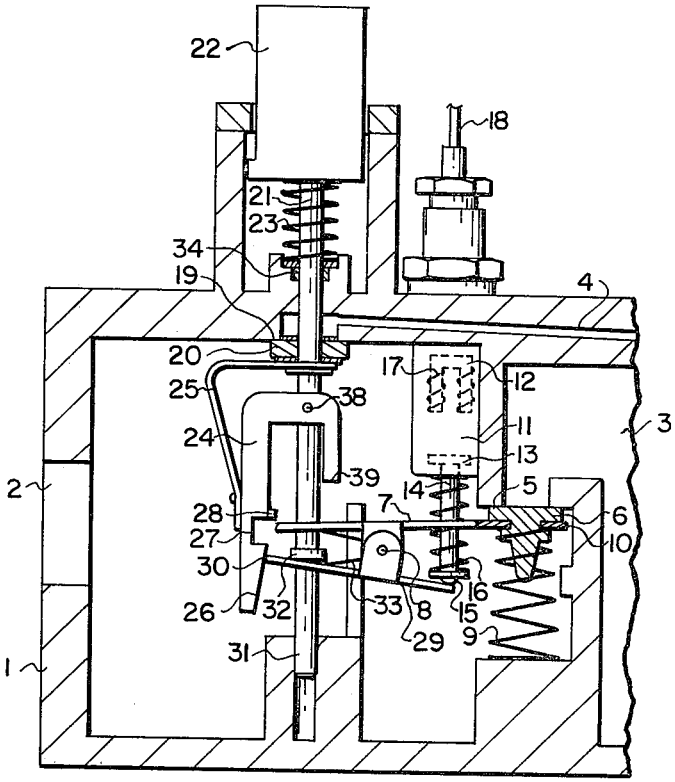
FIG. 1 shows the safety gas valve in the off position where the safety valve located between the inlet of the valve housing and the outlet to the main burner as well as the pilot valve located between the inlet and the pilot connection are closed and the electromagnet of the power unit is not energized.

The valve housing 1 comprises a gas inlet 2, a first outlet 3 and a second pilot outlet 4. Outlet 3 is connected to the main burner via a main gas valve (not shown). Between inlet 2 and main outlet 3, the safety valve is located and consists of valve seat 5 and closure member 6. The closure member is borne by a double armed lever 7 which is tiltable around a stationary axis 8. A closing spring 9 on the one side abutting against the housing presses the closure member 6 and the lever arm 10 carrying this closure member into the direction of valve seat 5.

An ignition safety device 11 comprises an electromagnet with core 12 and armature 13. This armature is held by an armature pin 14 to which a spring 16 engages via a collar 15 and tries to move the armature 13 away from core 12. An energizing coil 17 located on core 12 is by means of wiring 18 connected to a thermocouple (not shown) which is heated by the flame of the pilot burner. As long as the pilot flame is burning, current delivered by the thermocouple flows through the energizing coil 17 and gas for magnetization of core 12 of the electromagnet 12, 13, 17 of the ignition safety device or power unit 11. The pilot burner is connected to pilot outlet 4 and a pilot valve consisting of valve seat 19 and closure member 20 is provided between pilot connection 4 and inlet 2 of the valve housing. Closure member 20 is carried by operating rod 21 which can be pushed by means of push button 22 in the direction of the arrow against the force of reset spring 23. Operating rod 21 carries a latch 24 which is tiltable around axis 38 arranged perpendicular with respect to the movement of rod 21. By means of a spring 25, latch 24 is spring biased in counter-clockwise direction. Latch 24 has an inclined surface 26, a recess 27, a projection 28 and an abutment 39.

A second double armed lever 29 is tiltable around stationary axis 8, and the right end of this lever engages pin 14, where its left end 30 cooperates with latch 24. Operating rod 21 is guided in the housing at its upper portion as well as at its free end 31 and is provided with a collar 32 cooperating with the second lever 29. A straddle spring 33 forces the right portions of the two levers 7 and 29 away from each other. A seal 34 achieves gas-tight closing of the bore in the wall of the housing through which the operating rod extends.

In the off or resting position shown in FIG. 1, the safety valve 5, 6 as well as the pilot valve 19, 20 are closed. The electromagnet 12, 17 is deenergized and its armature 13 is pushed apart from core 12 by means of spring 16. Therewith, armature pin 14 simultaneously presses lever 29 in counter-clockwise direction against the inclined surface 26 of latch 24. This surface under the spring bias of spring 25 engages the left lever arm 30 of lever 29.

Figure 2:
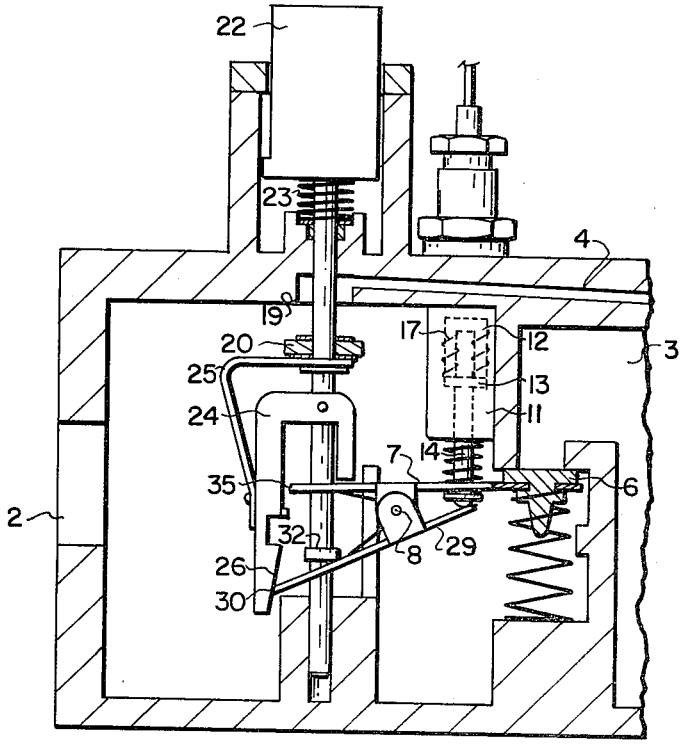
FIG. 2 shows the valve at the time when ignition is tried where the safety valve is closed, the pilot valve is open and the armature of the power unit is by manual operation pressed against its magnetic core.

If starting from the position shown in FIG. 1, the burner connected to main outlet 3 is to be put into operation, at first the pilot burner connected to pilot outlet 4 has to be ignited. For this purpose, as shown in FIG. 2, button 22 is pressed against reset spring 23, whereby closure member 20 of pilot valve 19, 20 is removed from seat 19. Therewith, gas flows through outlet 4 to the pilot burner and can be ignited there. When pressing button 22, collar 32 simultaneously turns the second lever 29 in counter-clockwise direction around axis 8, whereby the right end of lever 29 presses armature pin 14 in upward direction and therewith presses armature 13 against core 12 of the electromagnet of power unit 11. Spring 25 assures that latch 24 with its inclined surface 26 continues to engage the left end 30 of the second lever 29. As soon as the pilot flame is ignited, the current generated by the thermocouple flows through energizing coil 17 and leads to magnetization of core 12 so that the magnetic force keeps armature 13 engaging core 12 also in the case that the force of lever 29 pressing armature pin 14 in direction to core 12 should be removed.

Figure 3:
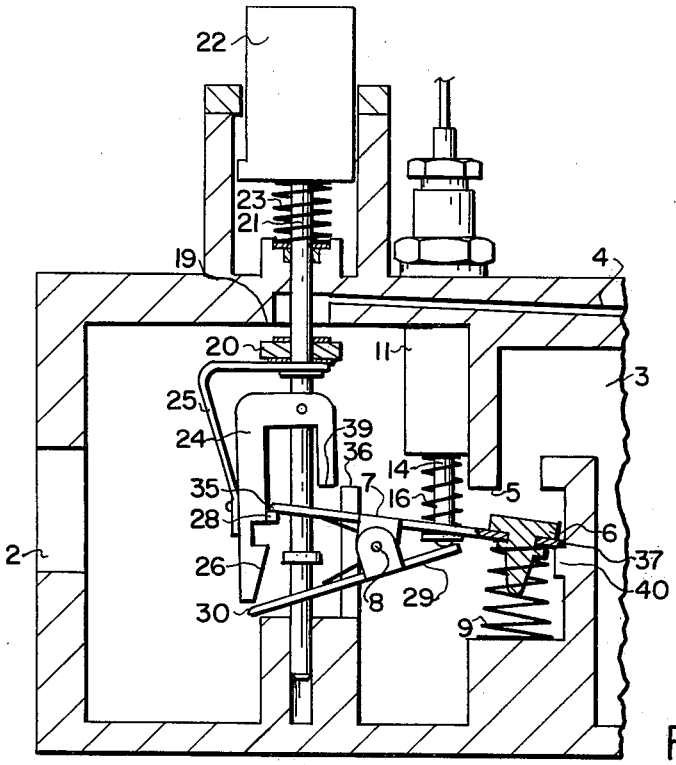
FIG. 3 shows the operating position of the safety gas valve in which the pilot valve as well as the safety valve are open and current flowing through the electromagnet draws the armature of the power unit against its magnetic core.

This happens when push button 22 is released and, as shown in FIG. 3, is partially removed in the direction of the off position. It does not completely reach the resting position according to FIG. 1 but is returned only so far that the pilot valve 19, 20 remains open. During this return movement from the position of FIG. 2, the inclined surface 26 disengages lever 30 so that latch 24 is turned by spring 25 in counter-clockwise direction and projection 28 moves under the left end 35 of the first lever 27 and therewith turns this lever in clockwise direction. It then comes into the normal operating position shown in FIG. 3 in which the safety valve 5, 6 is open. Now gas flows to the pilot burner as well as to the main burner, where the gas stream to the main burner is controlled in accordance with the demand of heat by means of an additional main gas valve (not shown). The return movement of the operating rod 21 is limited by the cooperation of abutments 37/40 and 28/35.

In case that, during normal operation, the pilot flame should extinguish, then, after cooling down of the thermocouple, the energizing coil 17 of electromagnet 12, 17 is deenergized and armature 13 is pressed away from core 12 by means of spring 16. Therewith, armature 13 turns the second lever 29 in clockwise direction around axis 8. The left end 30 of lever 29 presses via inclined surface 26 latch 24 in outward direction which means that latch 24 is turned by a little amount in clockwise direction, whereby projection 28 moves away from the left end 35 of first lever 7. Then closure member 9 can tilt lever 7 in counter-clockwise direction and press closure member 6 against seat 5. In this position, safety valve 5, 6 is closed. Simultaneously, the removal of projection 28 from the left end 35 of the lever results in that the operating push button 21 is no longer held in the pushed-in position by the cooperation of these two parts of the latch and the first lever 7. Reset spring 23 rather can move operating rod 21 in closing direction according to FIG. 1 so that the gas stream to the pilot burner is also interrupted by means of pilot valve 19, 20.

Figure 4:
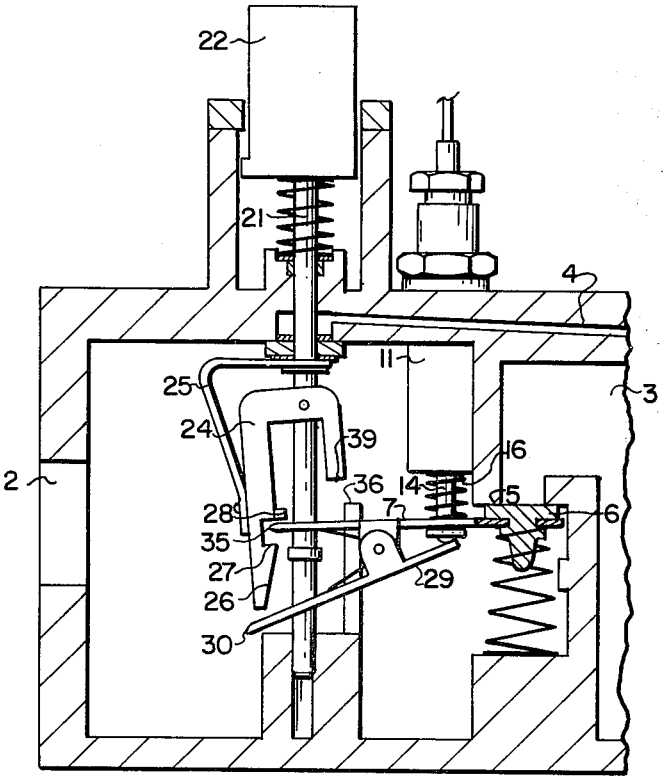
FIG. 4 shows the valves after intentional closing by hand when the electromagnet is still energized and the armature therefor did not yet drop out.

If, from the operating position shown in FIG. 3, the gas valve is to be closed manually, push button 22 and, together with it, operating rod 21 and latch 24 are slightly turned so that again projection 28 is disengaging left end 35 of first lever 7 and in the manner as described previously, the safety valve 5, 6 as well as the pilot valve 19, 20 are closed. During the return movement of operating rod 21 into the rest position, the left end 35 of lever 7 falls into recess 27 of latch 24 as shown in FIG. 4. Therewith, spring 35 can turn latch 24 in counterclockwise direction until abutment 39 of latch 24 is positioned opposite stationary abutment 36. In this position, shown in FIG. 4, the latch is effective. Operating rod 21 cannot be pushed inwardly and the safety valve 5, 6 cannot be opened as long as abutment 39 is positioned opposite abutment 36. Only when, after the cooling down of the thermocouple, the power unit 11 is deenergized and releases armature 13, recess spring 16 can push armature pin 14 downwardly. During this movement, the left end 30 of second lever 29 slides along inclined surface 26 of latch 24 and therewith turns latch 24 in clockwise direction into the resting position as shown in FIG. 1. Then, abutments 39 and 36 are no longer facing each other and a new ignition trial can be initiated as described above.

In the operating position according to FIG. 3, the return movement of the operating rod 21 under the force of spring 23 is limited by projection 28, engaging the left end 35 of lever 7. The turning movement of this lever, again in clockwise direction, is limited by a stationary abutment 37 facing the right lever arm.

What is claimed is:

1. Safety gas valve with latch which can be switched on and off by means of a shiftable and turnable operating rod, wherein a closure member is borne by a lever turnable around a stationary axis and is spring biased in closing direction by means of a spring;

an operating rod carries a spring biased tiltable latch, the tilting axis of which extends perpendicularly with respect to the direction of movement of the operating rod; and a projection of the latch is located opposite the lever arm of the lever which does not carry a closure member in such a way that during back movement of the operating rod from the ignition position into the operating position, the projection turns lever and with it closure member into the open position of the valve, whereby, if the valve were closed by turning the operating rod, an abutment of the latch is positioned opposite a stationary abutment and prevents pressing the operating rod until the armature of the electromagnet turns the latch out of the latching position when the electromagnet ceases to be energized by the current of a thermocouple; comprising an electromagnet of the ignition safety device is provided at the same side of the valve housing as is a push button borne by the operating rod;

a second lever is tiltable around the stationary axis;

a spring biased armature of the electromagnet engages at the one lever arm of the second lever;

a projection of the operating rod is positioned opposite the other lever arm of the second lever is such a manner that, when pushing the operating rod, the second lever presses the armature of the electromagnet against its core; and another lever arm is positioned opposite an inclined surface of the latch and turns this latch when the armature drops out in such a manner that the operating rod is released.

2. The invention of claim 1, wherein the latch has a recess into which the end of the first lever remote from the closure member projects touch-free.

3. The invention of claim 1, wherein the same abutment of the latch is positioned opposite the stationary abutment when the latch is engaged.

4. The invention of claim 1, wherein the tilting motion of the first lever in the direction of opening the valve is limited by means of a stationary abutment.

5. The invention of claim 1, wherein the operating rod is guided in the housing on both sides of the latch.

6. The invention of claim 1, wherein, when the valve is open, a projection of the latch engages end of the first lever which is remote from the closure member.

7. The invention of claim 1, wherein the first lever and the second lever are straddled like shears by means of a straddle spring.

* * * * *